US006135307A

United States Patent [19]

Fahy

[11] Patent Number: 6,135,307

[45] Date of Patent: Oct. 24, 2000

[54] CEREAL SIEVE BOWL

[76] Inventor: Joseph B. Fahy, 2 Ballyolaf Manor Parkvale Sandyford Road, Dublin 16, Ireland

[21] Appl. No.: 09/182,549

[22] Filed: Oct. 29, 1998

[51] Int. Cl.[7] ..... A47G 19/00

[52] U.S. Cl. ..... 220/574; 220/521; 220/527; 220/625; 220/627; 220/636

[58] Field of Search ..... 220/521, 522, 220/527, 625, 627, 630, 636, 574; 210/464, 469, 475, 499, 473, 474, 477; 99/446, 450, 495; 47/66.1

[56] References Cited

U.S. PATENT DOCUMENTS

| | | | |
|---|---|---|---|
| 1,334,342 | 3/1920 | Woods | 220/627 X |
| 1,673,703 | 6/1928 | Orman | 220/627 |
| 2,299,182 | 10/1942 | Schoof | 220/630 X |
| 3,477,175 | 11/1969 | Sakamoto | 220/630 X |
| 5,064,535 | 11/1991 | Hsu | 210/380.1 |

FOREIGN PATENT DOCUMENTS

| | | | |
|---|---|---|---|
| 628118 | 8/1949 | United Kingdom | 220/521 |

*Primary Examiner*—Stephen K. Cronin
*Assistant Examiner*—Joe Merek

[57] ABSTRACT

A cereal sieve bowl for separating cereal morsels from smaller crushed and powdery particulates of cereal in a package of cereal so that a user may enjoy a bowl of cereal without the distasteful smaller crushed and powdery particulates. The device includes a bowl having an upper reservoir designed for holding cereal therein. The bottom of the bowl has an opening therethrough. A collection base is coupled to the bottom of the bowl. The collection base defines a lower reservoir designed for holding crushed and particulates of cereal therein. A separation disk substantially closes the opening of the bottom of the bowl. The separation disk has a plurality of apertures of a predetermined size therethrough to prevent passage of morsels of cereal greater than the predetermined size in the upper reservoir from passing through the apertures into the lower reservoir while permitting passage of crushed and powdery particulates of cereal less that the predetermined size to pass into the lower reservoir.

13 Claims, 3 Drawing Sheets

CEREAL SIEVE BOWL

BACKGROUND OF THE INVENTION

1. Field of the Invention

The present invention relates to devices for separating cereal morsels from smaller crushed and powdery particulates of cereal in a package of cereal and more particularly pertains to a new cereal sieve bowl for separating cereal morsels from smaller crushed and powdery particulates of cereal in a package of cereal so that a user may enjoy a bowl of cereal without the distasteful smaller crushed and powdery particulates.

2. Description of the Prior Art

The use of devices for separating cereal morsels from smaller crushed and powdery particulates of cereal in a package of cereal is known in the prior art. More specifically, devices for separating cereal morsels from smaller crushed and powdery particulates of cereal in a package of cereal heretofore devised and utilized are known to consist basically of familiar, expected and obvious structural configurations, notwithstanding the myriad of designs encompassed by the crowded prior art which have been developed for the fulfillment of countless objectives and requirements.

Known prior art include U.S. Pat. No. 5,676,275; U.S. Pat. No. 5,341,953; U.S. Pat. No. Des. 348,803; U.S. Pat. No. 5,676,244; U.S. Pat. No. 2,118,591; and U.S. Pat. No. 2,197,449.

While these devices fulfill their respective, particular objectives and requirements, the aforementioned patents do not disclose a new cereal sieve bowl. The inventive device includes a bowl having an upper reservoir designed for holding cereal therein. The bottom of the bowl has an opening therethrough. A collection base is coupled to the bottom of the bowl. The collection base defines a lower reservoir designed for holding crushed and particulates of cereal therein. A separation disk substantially closes the opening of the bottom of the bowl. The separation disk has a plurality of apertures of a predetermined size therethrough to prevent passage of morsels of cereal greater than the predetermined size in the upper reservoir from passing through the apertures into the lower reservoir while permitting passage of crushed and powdery particulates of cereal less that the predetermined size to pass into the lower reservoir.

In these respects, the cereal sieve bowl according to the present invention substantially departs from the conventional concepts and designs of the prior art, and in so doing provides an apparatus primarily developed for the purpose of separating cereal morsels from smaller crushed and powdery particulates of cereal in a package of cereal so that a user may enjoy a bowl of cereal without the distasteful smaller crushed and powdery particulates.

SUMMARY OF THE INVENTION

In view of the foregoing disadvantages inherent in the known types of devices for separating cereal morsels from smaller crushed and powdery particulates of cereal in a package of cereal now present in the prior art, the present invention provides a new cereal sieve bowl construction wherein the same can be utilized for separating cereal morsels from smaller crushed and powdery particulates of cereal in a package of cereal so that a user may enjoy a bowl of cereal without the distasteful smaller crushed and powdery particulates.

The general purpose of the present invention, which will be described subsequently in greater detail, is to provide a new cereal sieve bowl apparatus and method which has many of the advantages of the devices for separating cereal morsels from smaller crushed and powdery particulates of cereal in a package of cereal mentioned heretofore and many novel features that result in a new cereal sieve bowl which is not anticipated, rendered obvious, suggested, or even implied by any of the prior art devices for separating cereal morsels from smaller crushed and powdery particulates of cereal in a package of cereal, either alone or in any combination thereof.

To attain this, the present invention generally comprises a bowl having an upper reservoir designed for holding cereal therein. The bottom of the bowl has an opening therethrough. A collection base is coupled to the bottom of the bowl. The collection base defines a lower reservoir designed for holding crushed and particulates of cereal therein. A separation disk substantially closes the opening of the bottom of the bowl. The separation disk has a plurality of apertures of a predetermined size therethrough to prevent passage of morsels of cereal greater than the predetermined size in the upper reservoir from passing through the apertures into the lower reservoir while permitting passage of crushed and powdery particulates of cereal less that the predetermined size to pass into the lower reservoir.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cereal sieve bowl apparatus and method which has many of the advantages of the devices for separating cereal morsels from smaller crushed and powdery particulates of cereal in a package of cereal mentioned heretofore and many novel features that result in a new cereal sieve bowl which is not anticipated, rendered obvious, suggested, or even implied by any of the prior art devices for separating cereal morsels from smaller crushed and powdery particulates of cereal in a package of cereal, either alone or in any combination thereof.

It is another object of the present invention to provide a new cereal sieve bowl which may be easily and efficiently manufactured and marketed.

It is a further object of the present invention to provide a new cereal sieve bowl which is of a durable and reliable construction.

An even further object of the present invention is to provide a new cereal sieve bowl which is susceptible of a low cost of manufacture with regard to both materials and labor, and which accordingly is then susceptible of low prices of sale to the consuming public, thereby making such cereal sieve bowl economically available to the buying public.

Still yet another object of the present invention is to provide a new cereal sieve bowl which provides in the apparatuses and methods of the prior art some of the advantages thereof, while simultaneously overcoming some of the disadvantages normally associated therewith.

Still another object of the present invention is to provide a new cereal sieve bowl for separating cereal morsels from smaller crushed and powdery particulates of cereal in a package of cereal so that a user may enjoy a bowl of cereal without the distasteful smaller crushed and powdery particulates.

Yet another object of the present invention is to provide a new cereal sieve bowl which includes a bowl having an upper reservoir designed for holding cereal therein. The bottom of the bowl has an opening therethrough. A collection base is coupled to the bottom of the bowl. The collection base defines a lower reservoir designed for holding crushed and particulates of cereal therein. A separation disk substantially closes the opening of the bottom of the bowl. The separation disk has a plurality of apertures of a predetermined size therethrough to prevent passage of morsels of cereal greater than the predetermined size in the upper reservoir from passing through the apertures into the lower reservoir while permitting passage of crushed and powdery particulates of cereal less that the predetermined size to pass into the lower reservoir.

Still yet another object of the present invention is to provide a new cereal sieve bowl that lets a user enjoy whole morsels of cereal from start to finish of a package of cereal.

Even still another object of the present invention is to provide a new cereal sieve bowl that collects the smaller crushed and powdery particulates of cereal so that they may be used in other applications such as baking.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
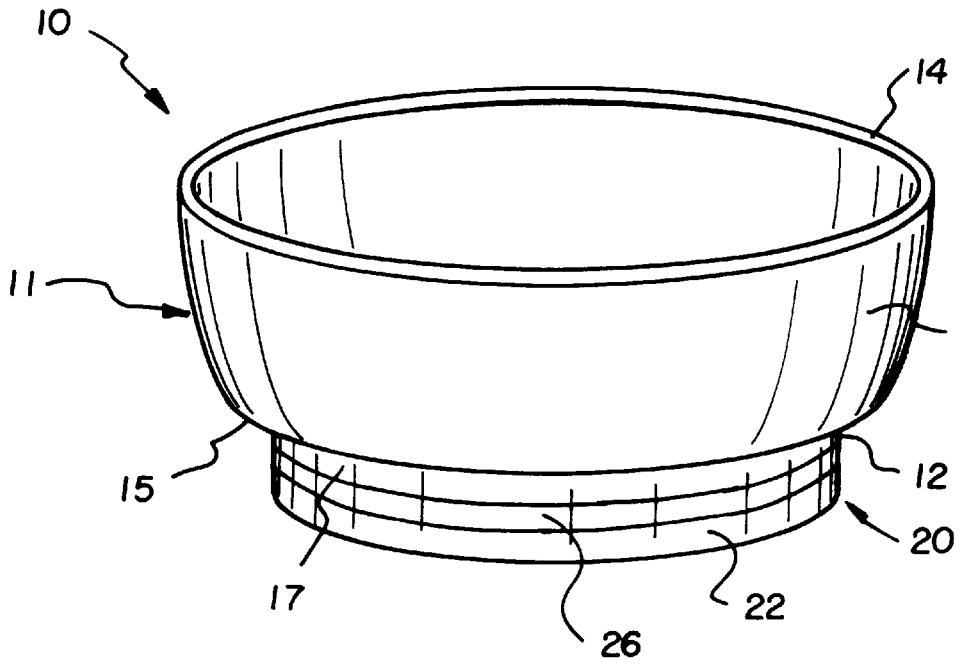
FIG. 1 is a schematic perspective view of a new cereal sieve bowl according to the present invention.
Figure 2:
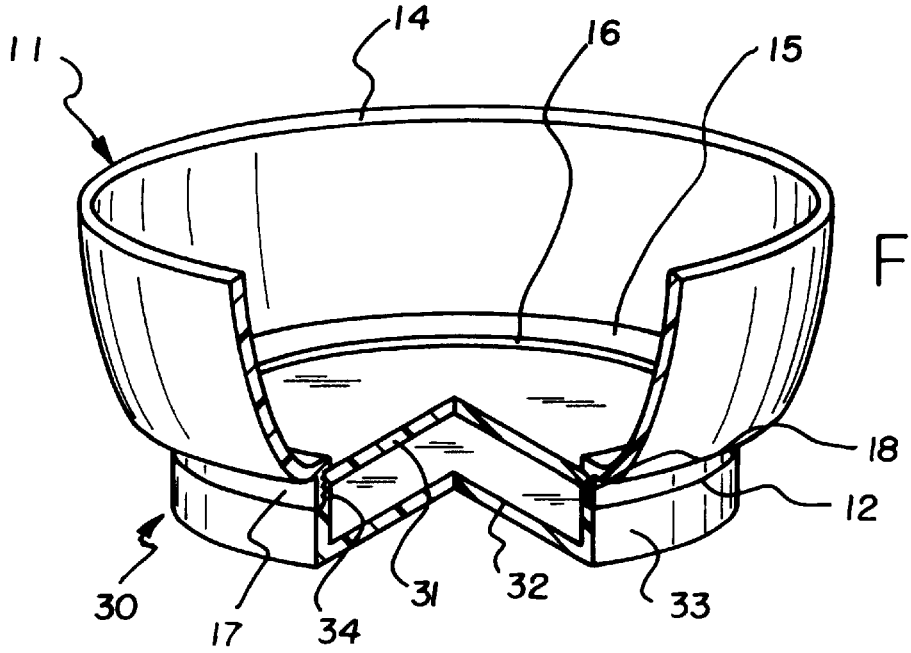
FIG. 2 is a schematic break away perspective view of the present invention with the optional second base attached to the bowl.
Figure 3:
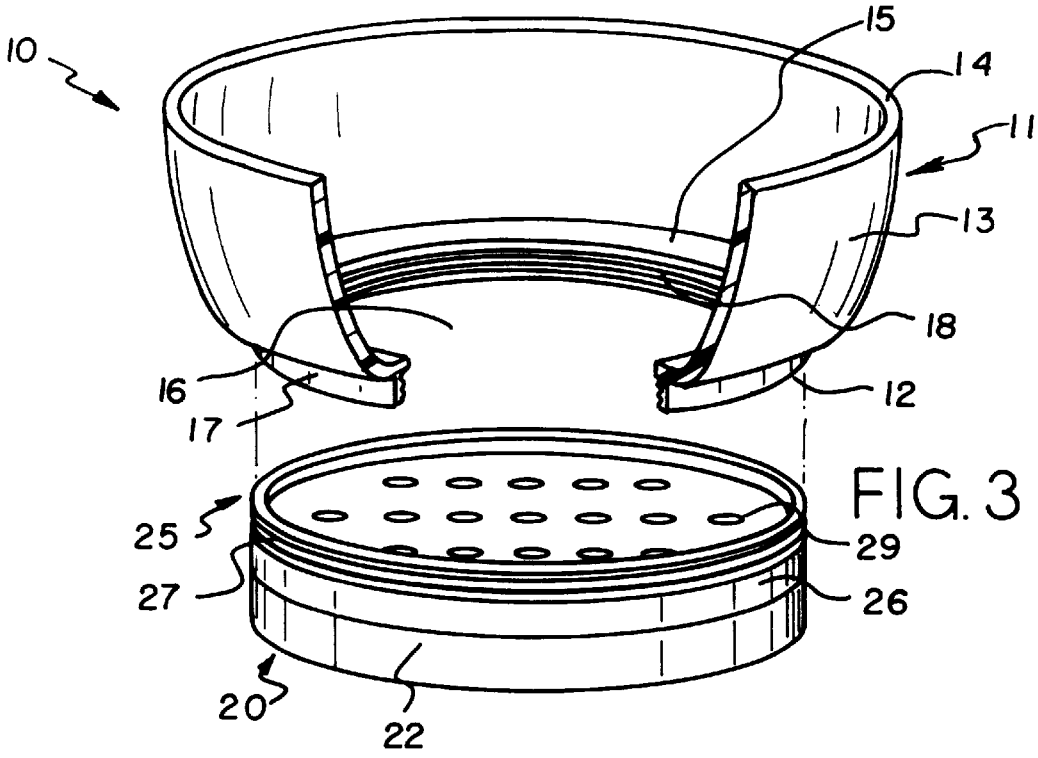
FIG. 3 is a schematic exploded partial breakaway view of the present invention.
Figure 4:
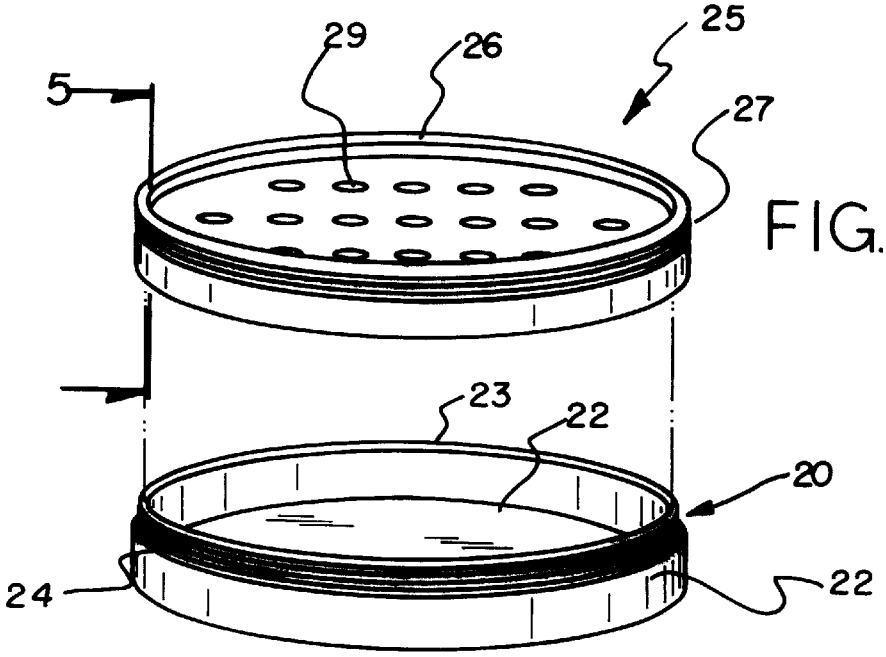
FIG. 4 is a schematic exploded view of the collection base and the separation disk of the present invention.
Figure 5:
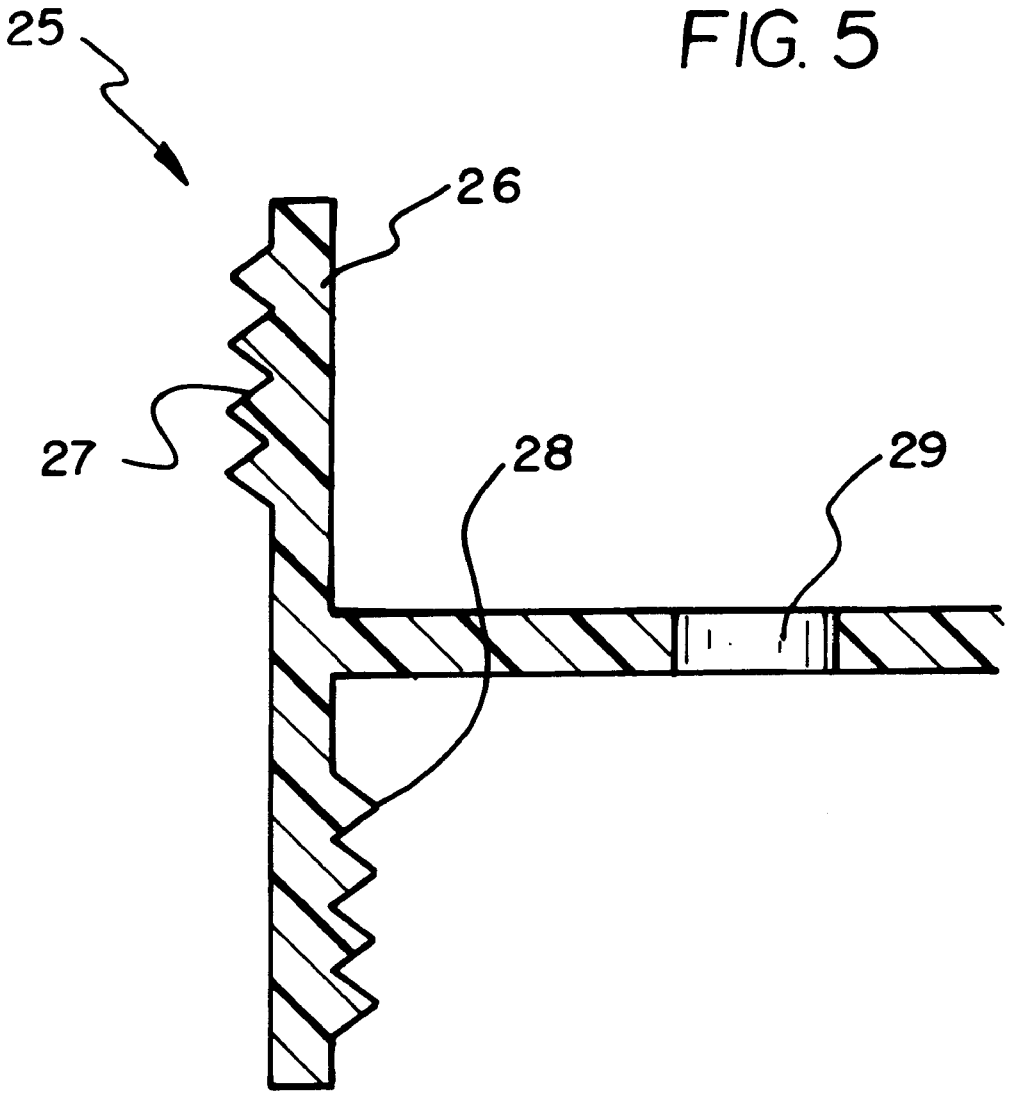
FIG. 5 is a schematic partial cross sectional view of the separation device of the present invention taken from line 5—5 of FIG. 4.

With reference now to the drawings, and in particular to FIGS. 1 through 5 thereof, a new cereal sieve bowl embodying the principles and concepts of the present invention and generally designated by the reference numeral 10 will be described.

As best illustrated in FIGS. 1 through 5, the cereal sieve bowl 10 generally comprises a bowl 11 having an upper reservoir designed for holding cereal therein. The bottom 12 of the bowl 11 has an opening therethrough. A collection base 20 is coupled to the bottom 12 of the bowl 11. The collection base 20 defines a lower reservoir designed for holding crushed and particulates of cereal therein. A separation disk 25 substantially closes the opening 16 of the bottom 12 of the bowl 11. The separation disk 25 has a plurality of apertures 29 of a predetermined size therethrough to prevent passage of morsels of cereal greater than the predetermined size in the upper reservoir from passing through the apertures 29 into the lower reservoir while permitting passage of crushed and powdery particulates of cereal less that the predetermined size to pass into the lower reservoir.

In use, the cereal sieve bowl 10 is a device for separating generally whole morsels of cereal from smaller crushed and powdery particulates of cereal from a package of cereal by pouring cereal from a package of cereal into the upper reservoir and then separating the crushed and powdery particulates of cereal from the generally whole morsels by use the separation disks.

In closer detail, a bowl 11 has a bottom 12 and a perimeter side wall 13 upwardly extending around the bottom 12 of the bowl 11 to define an upper reservoir designed for holding morsels of cereal therein. The perimeter side wall 13 of the bowl 11 has an annular upper rim 14 which defines a generally circular top opening into the upper reservoir. The perimeter side wall 13 has an annular shoulder 15 adjacent bottom 12 of the bowl 11 extending radially inwards towards a center of the bowl 11. Preferably, the shoulder 15 and the upper rim 14 of the perimeter side wall 13 generally lie in parallel planes to one another. In an ideal illustrative embodiment, the perimeter side wall 13 has a height defined between the shoulder 15 and the upper rim 14 of about 8 cm and the upper rim 14 of the perimeter side wall 13 has a diameter of about 15 cm.

The bottom 12 of the bowl 11 has an opening therethrough. The opening 16 of the bottom 12 of the bowl 11 has a generally circular periphery. The bottom 12 of the bowl 11 has an annular lower lip 17 downwardly depending from the shoulder 15 of the perimeter side wall 13 around the opening 16 of the bottom 12 of the bowl 11. The annular lower lip 17 has a threaded inner perimeter 18 along the outer periphery of the opening 16 of the bottom 12 of the bowl 11.

The collection base 20 has bottom panel 21 and a perimeter wall 22 upwardly extending around the bottom panel 21 of the collection base 20. The bottom panel 21 and the perimeter wall 22 of the collection base 20 defines a lower reservoir designed for holding crushed and particulates of cereal therein. The bottom panel 21 of the collection base 20 is generally circular and the perimeter wall 22 of the collection base 20 is generally cylindrical. The perimeter wall 22 has an annular upper edge 23 defining an opening into the lower reservoir. The perimeter side wall 13 of the collection base 20 has an outer threaded portion 24 therearound adjacent the upper edge 23 of the perimeter wall 22.

The separation disk 25 has an annular lip 26 therearound. The annular lip 26 of the separation disk 25 has an outer upper threaded portion 27 therearound and an inner lower threaded portion 28. The separation disk 25 substantially covers the upper edge 23 of the perimeter side wall 13. The inner lower threaded portion 28 of the annular lip 26 of the separation disk 25 is threadably coupled to the outer threaded portion 24 of the perimeter wall 22 of the collection base 20. The separation disk 25 is inserted into the opening 16 of the bottom 12 of the bowl 11 to substantially close the opening 16 of the bottom 12 of the bowl 11. The outer upper threaded portion 27 of the annular lip 26 of the separation disk 25 is threadably coupled to the threaded inner perimeter 18 of the annular lower lip 17 of the bottom 12 of the bowl 11. Ideally, the separation disk 25, the bowl 11 and the collection base 20 have generally coaxial centers. The separation disk 25 has a plurality of generally circular apertures 29 of a desired predetermined size (Ideally greater than about 5 mm) therethrough to prevent passage of morsels of cereal greater than the predetermined size in the upper reservoir from passing through the apertures 29 into the lower reservoir while permitting passage of crushed and powdery particulates of cereal less that the predetermined size to pass into the lower reservoir and thereby separate the desirable morsels of cereal from the crushed and powdery particulates of cereal. Optionally, the cereal sieve bowl 10 may further include a plurality of separation disks each with apertures of different predetermined size so that a user may select a different separation disk 25 for various different sizes of morsels of cereal.

Optionally, a generally disk-shaped second base 30 may be provided having generally circular top and bottom panels 31,32 and a cylindrical side 33 between the top and bottom panels 31,32. The cylindrical side 33 of the second base 30 has a threaded region 34 adjacent the top panel 31 of the second base 30. The top panel 31 of the second base 30 is insertable into the opening 16 of the bottom 12 of the bowl 11 to close the opening 16 of the bottom 12 of the bowl 11, the threaded region 34 of the second base 30 is threadably attachable to the threaded inner perimeter 18 of the annular lower lip 17 of the bowl 11;

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for separating generally whole morsels of cereal from smaller crushed and powdery particulates of cereal from a package of cereal, said device comprising:

a bowl having a bottom and an upper reservoir adapted for holding cereal therein;

said bottom of said bowl having an opening therethrough;

a collection base defining a lower reservoir adapted for holding crushed and particulates of cereal therein, said collection base being coupled to said bottom of said bowl;

a separation disk substantially closing said opening of said bottom of said bowl;

said separation disk having a plurality of apertures of a predetermined size therethrough to prevent passage of morsels of cereal greater than said predetermined size in said upper reservoir from passing through said apertures into said lower reservoir while permitting passage of crushed and powdery particulates of cereal less than the predetermined size to pass into the lower reservoir:

wherein said bottom of said bowl has an annular lower lip downwardly depending from said shoulder of said perimeter side wall around said opening of said bottom of said bowl, said annular lower lip having a threaded inner perimeter along an outer periphery of said opening of said bottom of said bowl; and wherein said collection base has a bottom panel and having a perimeter wall upwardly extending around said bottom panel of said collection base, said perimeter wall having an annular upper edge defining an opening into said lower reservoir, said perimeter side wall of said collection base having an outer threaded portion therearound adjacent said upper edge of said perimeter wall.

2. The system of claim 1, wherein said bowl has a perimeter side wall upwardly extending around said bottom of said bowl, said perimeter side wall of said bowl having an annular upper rim defining a generally circular top opening into said upper reservoir.

3. The system of claim 2, wherein said perimeter side wall has an annular shoulder adjacent the bottom of said bowl extending radially inwards.

4. The system of claim 3, wherein said shoulder and said upper rim of said perimeter side wall generally lying in parallel planes to one another.

5. The system of claim 1, wherein said separation disk has an annular lip therearound, said annular lip of said separation disk having an outer upper threaded portion therearound and an inner lower threaded portion, said inner lower threaded portion of said annular lip of said separation disk being threadably coupled to said outer threaded portion of said perimeter wall of said collection base, said separation disk being inserted into said opening of said bottom of said bowl to substantially close said opening of said bottom of said bowl, said outer upper threaded portion of said annular lip of said separation disk being threadably coupled to said threaded inner perimetric of said annular locater lip of said bottom of said bowl.

6. A system of claim 1, wherein said separation disk, said bowl and said collection base having generally coaxial centers.

7. The system of claim 1, further comprising a second base being generally disk-shaped in configuration and having generally circular top and bottom panels and a cylindrical side between said top and bottom panels, said cylindrical side of said second base having a threaded region adjacent said top panel of said second base, said top panel of said second base being insertable into said opening of said bottom of said bowl to close said opening of said bottom of said bowl, said threaded region of said second base being threadably attachable to said threaded inner perimeter of said annular lower lip of said bowl.

8. A system for separating generally whole morsels of cereal from smaller crushed and powdery particulates of cereal from a package of cereal, said device comprising:

a bowl having a bottom and a perimeter side wall upwardly extending around said bottom of said bowl to define an upper reservoir adapted for holding cereal therein;

said perimeter side wall of said bowl having an annular upper rim defining a generally circular top opening into said upper reservoir;

said perimeter side wall having an annular shoulder adjacent bottom of said bowl extending radially inwards;

said shoulder and said upper rim of said perimeter side wall generally lying in parallel planes to one another;

said bottom of said bowl having an opening therethrough, said opening of said bottom of said bowl having a generally circular periphery;

said bottom of said bowl having an annular lower lip downwardly depending from said shoulder of said perimeter side wall around said opening of said bottom of said bowl;

said annular lower lip having a threaded inner perimeter along said outer periphery of said opening of said bottom of said bowl;

a collection base having a bottom panel and having a perimeter wall upwardly extending around said bottom panel of said collection base, said bottom panel and said perimeter wall of said collection base defining a lower reservoir adapted for holding crushed and particulates of cereal therein, said bottom panel of said collection base being generally circular, said perimeter wall of said collection base being generally cylindrical;

said perimeter wall having an annular upper edge defining an opening into said lower reservoir, said perimeter side wall of said collection base having an outer threaded portion therearound adjacent said upper edge of said perimeter wall;

a separation disk having an annular lip therearound, said annular lip of said separation disk having an outer upper threaded portion therearound and an inner lower threaded portion;

said separation disk substantially covering said upper edge of said perimeter side wall, said inner lower threaded portion of said annular lip of said separation disk being threadably coupled to said outer threaded portion of said perimeter wall of said collection base;

said separation disk being inserted into said opening of said bottom of said bowl to substantially close said opening of said bottom of said bowl, said outer upper threaded portion of said annular lip of said separation disk being threadably coupled to said threaded inner perimeter of said annular lower lip of said bottom of said bowl;

said separation disk, said bowl and said collection base having generally coaxial centers;

said separation disk having a plurality of generally circular apertures of a predetermined size therethrough to prevent passage of morsels of cereal greater than said predetermined size in said upper reservoir from passing through said apertures into said lower reservoir while permitting passage of crushed and powdery particulates of cereal less than the predetermined size to pass into the lower reservoir; and a second base being generally disk-shaped in configuration and having generally circular top and bottom panels and a cylindrical side between said top and bottom panels, said cylindrical side of said second base having a threaded region adjacent said top panel of said second base, said top panel of said second base being insertable into said opening of said bottom of said bowl to close said opening of said bottom of said bowl, said threaded region of said second base being threadably attachable to said threaded inner perimeter of said annular lower lip of said bowl.

9. A system for separating generally whole morsels of cereal from smaller crushed and powdery particulates of cereal from a package of cereal, said device comprising:

a bowl having a bottom and an upper reservoir adapted for holding cereal therein;

said bottom of said bowl having an opening therethrough;

a collection base defining a lower reservoir adapted for holding crushed and particulates of cereal therein, said collection base being coupled to said bottom of said bowl;

a separation disk substantially closing said opening of said bottom of said bowl;

said separation disk having a plurality of apertures of a predetermined size therethrough to prevent passage of morsels of cereal greater than said predetermined size in said upper reservoir from passing through said apertures into said lower reservoir while permitting passage of crushed and powdery particulates of cereal less than the predetermined size to pass into the lower reservoir; and a second base being generally disk-shaped in configuration and having generally circular top and bottom panels and a cylindrical side between said top and bottom panels, said cylindrical side of said second base having a threaded region adjacent said top panel of said second base, said top panel of said second base being insertable into said opening of said bottom of said bowl to close said opening of said bottom of said bowl, said threaded region of said second base being threadably attachable to said threaded inner perimeter of said annular lower lip of said bowl.

10. The system of claim 9, wherein said bowl has a perimeter side wall upwardly extending around said bottom of said bowl, said perimeter side wall of said bowl having an annular upper rim defining a generally circular top opening into said upper reservoir.

11. The system of claim 10, wherein said perimeter side wall has an annular shoulder adjacent the bottom of said bowl extending radially inwards.

12. The system of claim 11, wherein said shoulder and said upper rim of said perimeter side wall generally lying in parallel planes to one another.

13. The system of claim 9, wherein said separation disk, said bowl and said collection base having generally coaxial centers.

* * * * *